US005970540A

United States Patent [19]

Cheng

[11] Patent Number: 5,970,540

[45] Date of Patent: Oct. 26, 1999

[54] FOLDABLE BASE FOR A PLAYPEN

[76] Inventor: Ching-Wen Cheng, 3rd Fl., No. 100, Wenlin N. Rd., Peitou Dist., Taipei, Taiwan

[21] Appl. No.: 09/099,445

[22] Filed: Jun. 18, 1998

[30] Foreign Application Priority Data

Feb. 20, 1998 [TW] Taiwan ..... 87202458

[51] Int. Cl.[6] ..... A47D 13/06

[52] U.S. Cl. ..... 5/99.1; 5/98.1

[58] Field of Search ..... 5/98.1, 99.1; 403/102, 403/119, 117; 16/326, 327

[56] References Cited

U.S. PATENT DOCUMENTS

| | | | |
|---|---|---|---|
| 5,353,451 | 10/1994 | Hsiung | 5/98.1 X |
| 5,497,517 | 3/1996 | Wang | 5/99.1 |
| 5,730,542 | 3/1998 | Cheng | 5/98.1 X |
| 5,781,944 | 7/1998 | Huang | 5/98.1 X |

FOREIGN PATENT DOCUMENTS

| | | | |
|---|---|---|---|
| 353146 | 3/1961 | Switzerland | 403/102 |

*Primary Examiner*—Terry Lee Melius
*Assistant Examiner*—Rodrigo J. Morales
*Attorney, Agent, or Firm*—Bacon & Thomas, PLLC

[57] ABSTRACT

An improved foldable base for a playpen includes a first pair of side rails pivotally connected to a first side joint and a second pair of side rails pivotally connected to a second side joint. A pair of T-shaped joints are situated between the pairs of rails. A center joint is located in a center of the playpen and has an outer and an inner joint members pivotally connected with each other. Two pairs of bars are provided, each pair of the bars pivotally connected with one of the respective T-shaped joints and with two of the respective side rails. Two linking rods are also provided, each pivotally connected at an end thereof with one of the respective T-shaped joints and secured at an opposing end thereof to one of the respective joint members of the center joint.

1 Claim, 8 Drawing Sheets

FOLDABLE BASE FOR A PLAYPEN

FIELD OF THE INVENTION

The present invention relates to a foldable base for a playpen and, more particularly, to a foldable base which has excellent support for a baby therein.

BACKGROUND OF THE INVENTION Playpens were originally made of wood and were unfoldable. Foldable playpens were later developed because they could be folded up to minimize the space for storage or other purposes.

A conventional foldable playpen typically comprises a foldable base having a center joint and several linking rods which are each pivotally connected at an end thereof with the center joint and jointed at an opposite end thereof to one of the respective corners of the foldable base. However, a foldable base constructed with a thin wooden board forming the bottom of the playpen which is supported by side rails immediately beneath the edges of the board and by the linking rods arranged non-structurally could easily collapse when a baby stands or is laid thereon.

SUMMARY OF THE INVENTION

The object of the present invention is to provide a foldable base which has excellent support for a baby therein.

Another object of the present invention is to provide a foldable base which has a locking means for securing the foldable base in a fully stretching configuration, preventing the foldable base from being unreasonably folded up.

DETAILED DESCRIPTION OF PREFERRED EMBODIMENT

Figure 1:
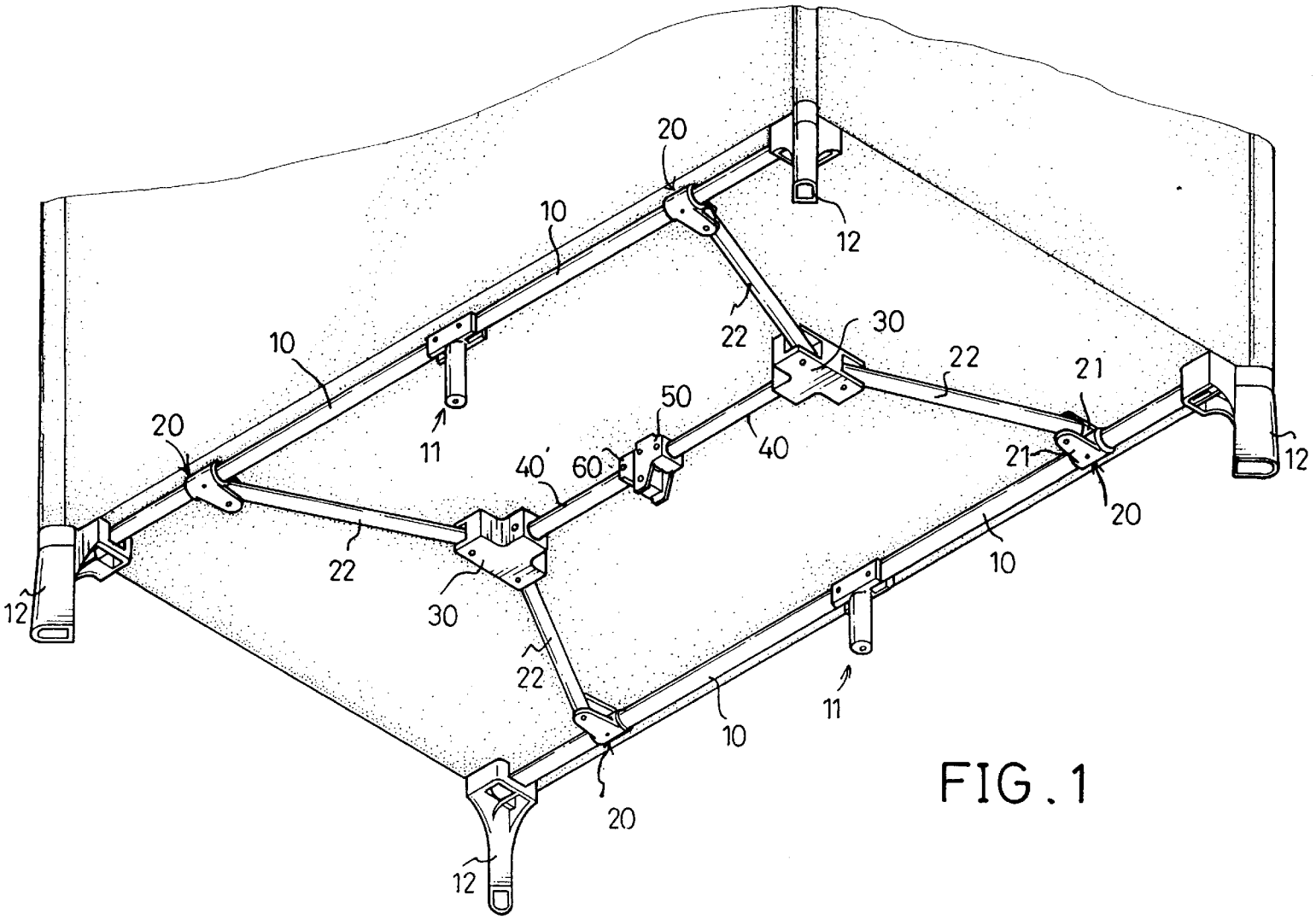
FIG. 1 is a perspective bottom view of a preferred embodiment of a foldable base in accordance with the present invention for a playpen.
Figure 2:
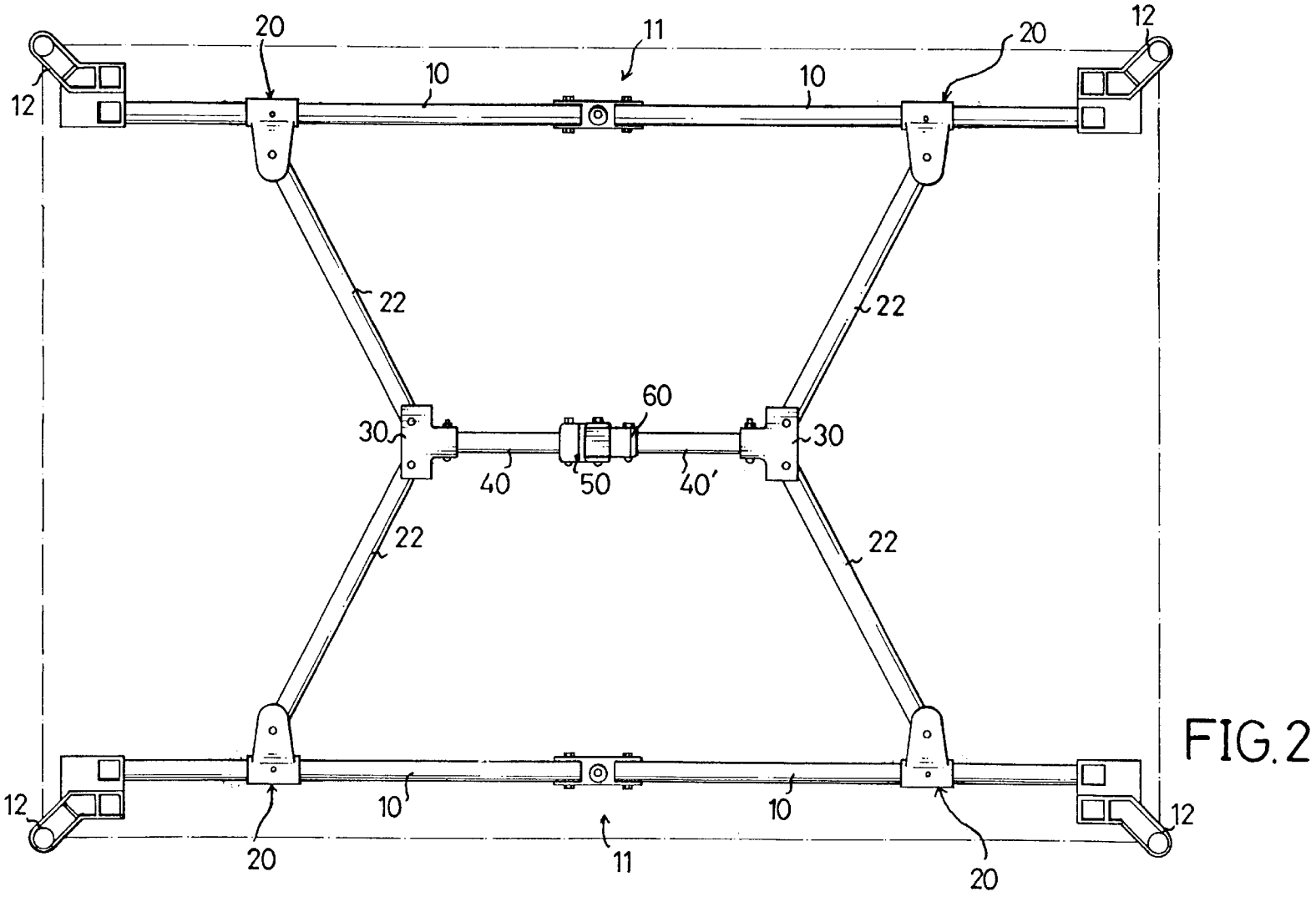
FIG. 2 is a plan view of the foldable base shown in FIG. 1.

FIGS. 1 and 2 show bottom views of a foldable base in accordance with the present invention. The foldable base includes two pairs of side rails 10, with each pair of side rails 10 pivotally connected to a side joint/foot member 11. Moreover, each of the side rails 10 has a corner foot member 12 secured to an outer portion thereof to support, together with the side foot members 11, the playpen on the floor.

Located between the pairs of side rails 10 are a pair of T-shaped joints 30, each pivotally connected with a pair of bars 22 which are in turn pivotally connected with a respective one of the rails 10, via an ear 20. In the illustrated embodiment, the ears 20 of the rails 10 each have a pair of wings 21 extending from one of the rails 10 and receives an end of the bar 22 therebetween.

A center joint is positioned in a center of the foldable base. The center joint includes an outer joint member and an inner joint member 50 and 60 that are pivotally connected with each other. A first linking rod 40 pivotally connected at an end thereof with the outer joint member 50 of the center joint and secured at an opposing end thereof to one of the T-shaped joints 30, while a second linking rod 40' pivotally connected at an end thereof with the inner joint member 60 of the center joint and secured at an opposing end thereof to the other one of the T-shaped joints 30.

Figure 3:
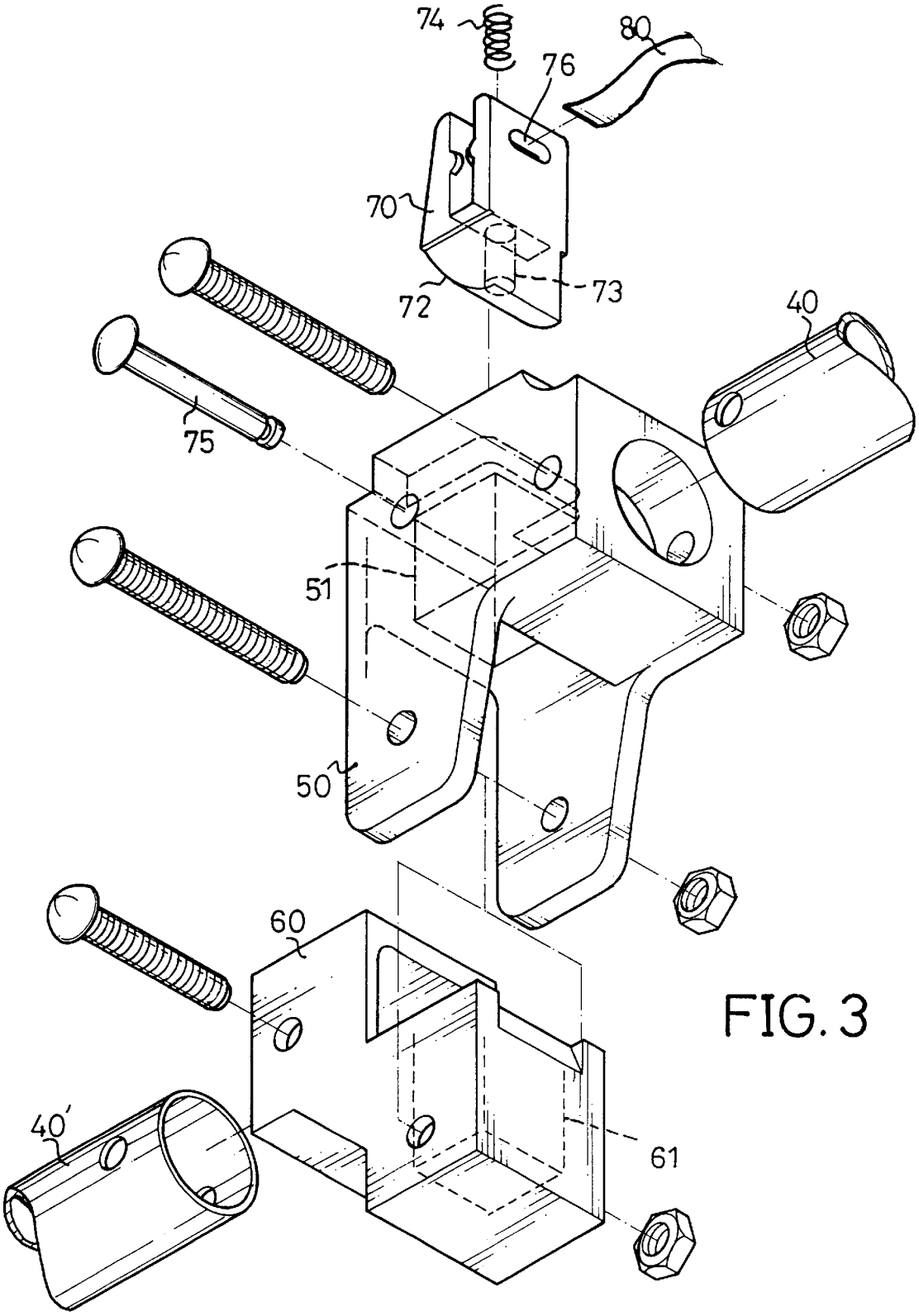
FIG. 3 is a perspective view of a preferred center joint used in the foldable base shown in FIGS. 1 and 2.
Figure 4:
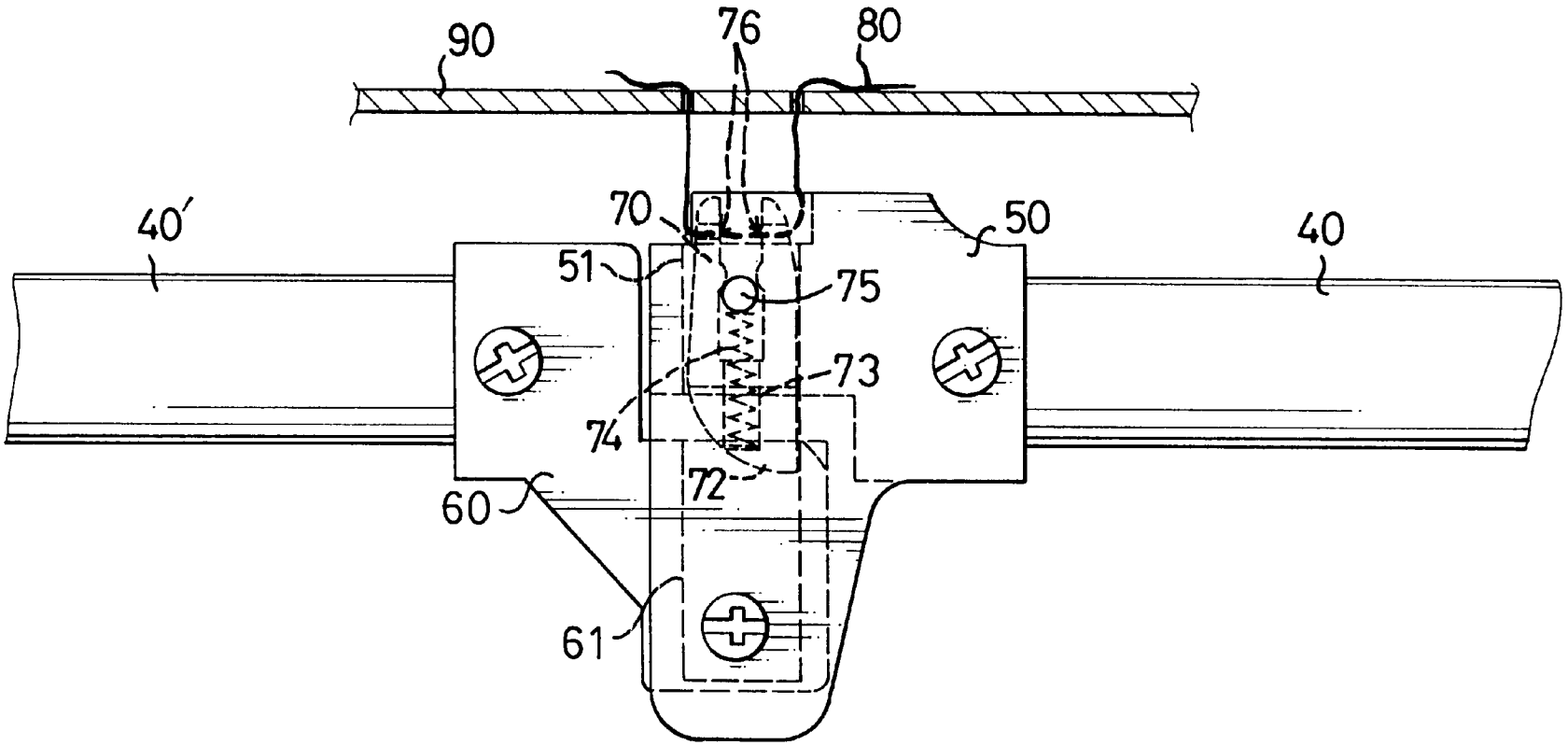
FIG. 4 is a plan view showing the center joint in a locked position.

Referring to FIGS. 3 and 4, it is preferable that the center joint includes locking means for preventing and allowing the rotation of the outer and inner joint members 50 and 60, and hence of the linking rods 40, 40'.

In a preferred embodiment, the locking means includes a through-hole 51 defined in the outer joint member 50, a recess 61 defined in the inner joint member 60 and aligned with the through-hole 51 of the outer joint member 50 when the foldable base is fully extended, an inverted U-shaped latch member 70 movably disposed in the through-hole 51 of the outer joint member 50 and having a latch tongue 72 for facilitating the latch member 70 to extend into the recess 61 of the inner joint member 60, a blind slot 73 formed in the latch member 70, a spring 74 received in the blind slot 73 for biasing the latch member 70, and a pin 75 laterally extending through the outer joint member 50 and in contact with an end of the spring 74 for retaining the spring 74 in the blind slot 73.

More preferably, the latch has a hole 76 defined therein through which a strap 80 extends. Ends of the strap 80 are fixedly attached to a bottom board 90 of the playpen, so that the locking means may be easily unlocked by pulling the bottom board 90.

Figure 5:
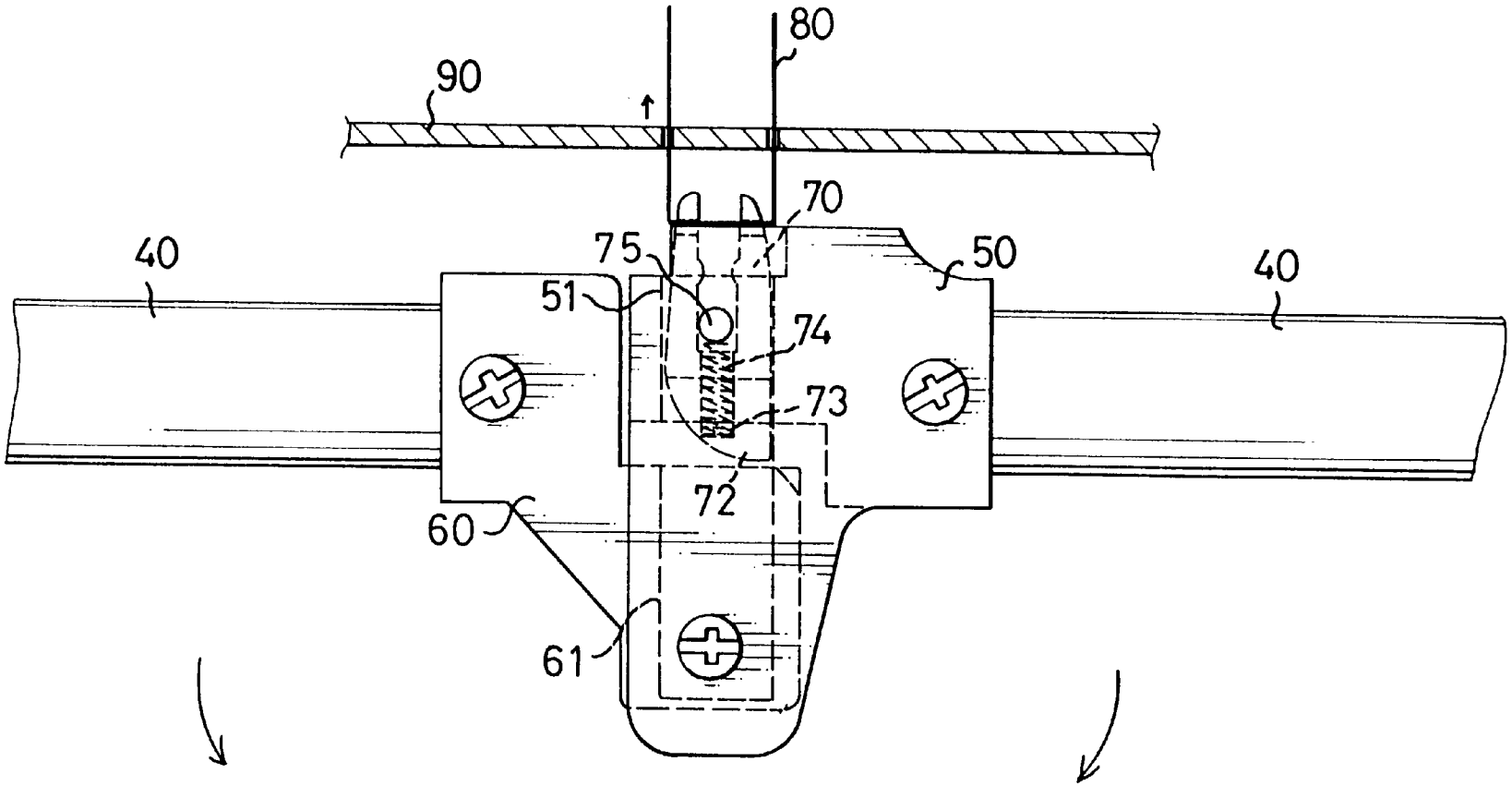
FIG. 5 is a plan view showing the center joint in an unlocked position.
Figure 6:
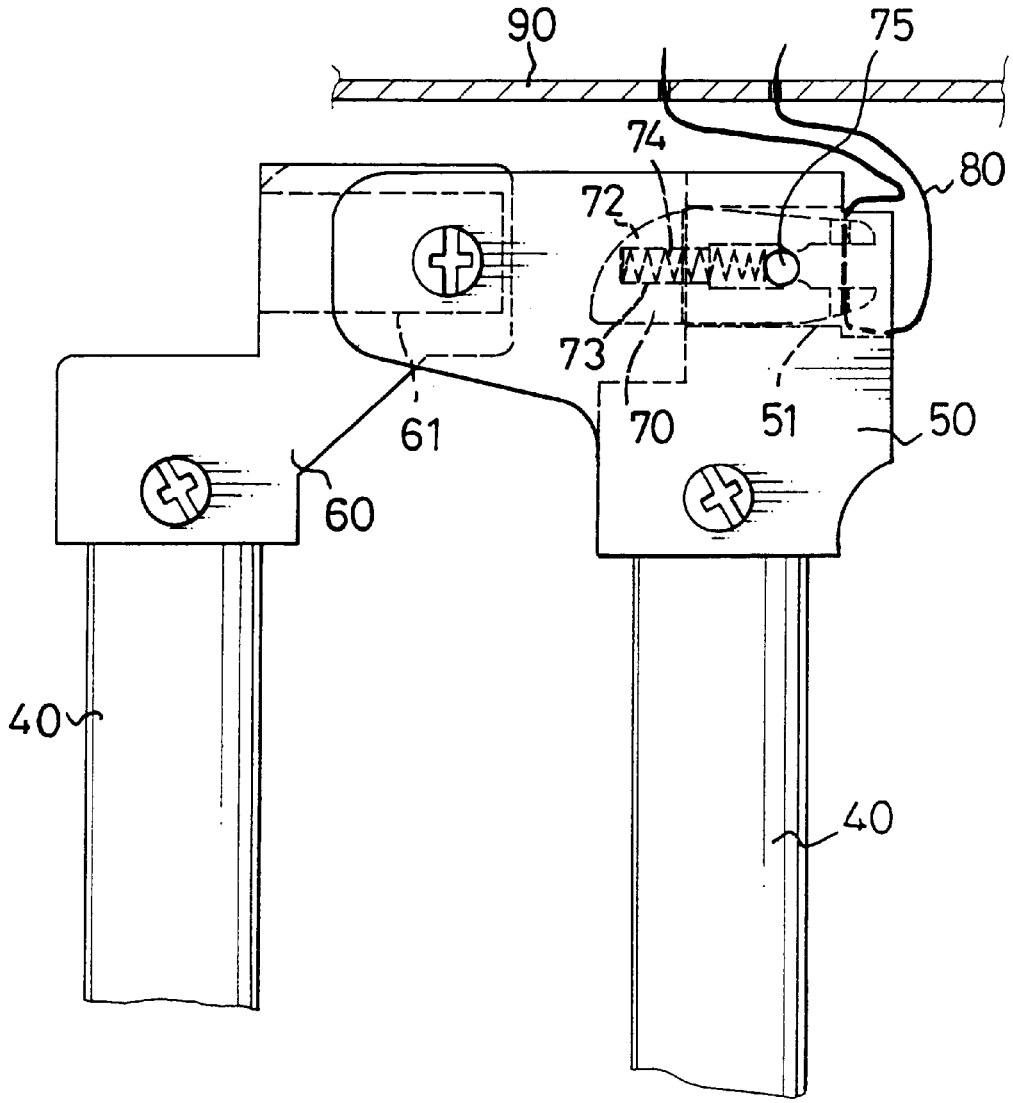
FIG. 6 is a side view of the center joint with an inner joint member and an outer joint member rotated with respect to each other.
Figure 7:
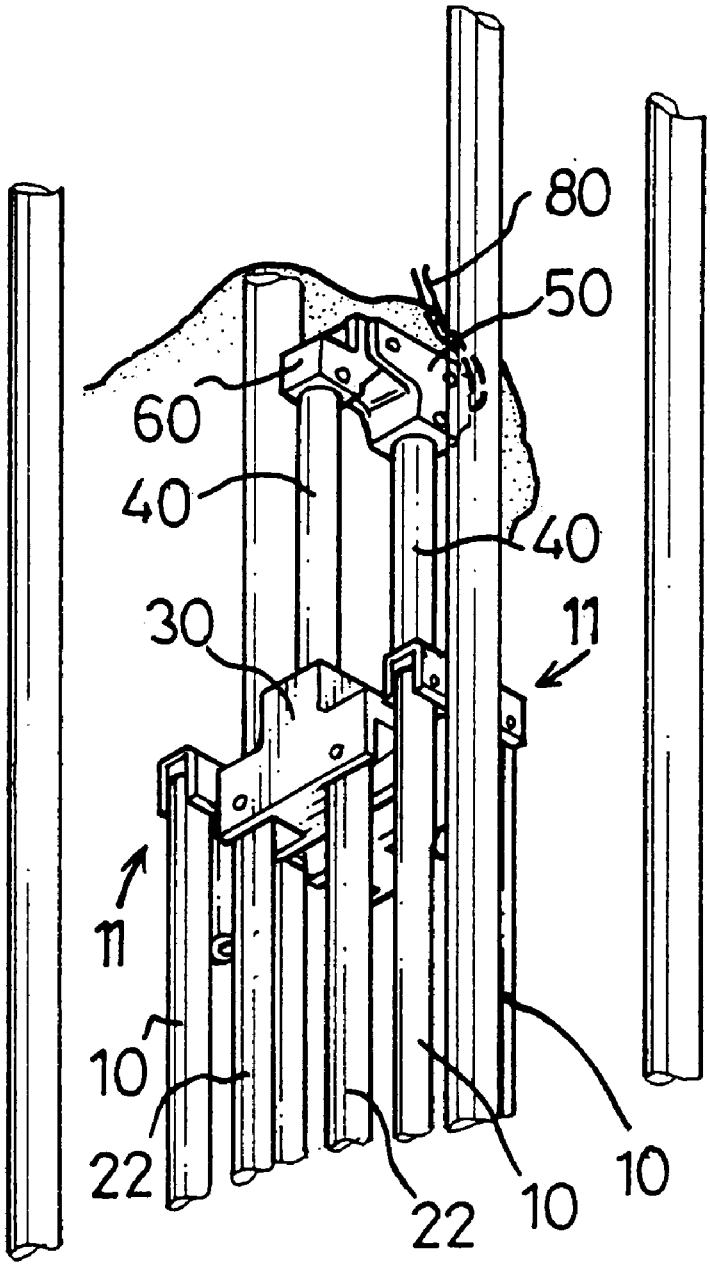
FIG. 7 is a view of the foldable base in a folded configuration.

Referring to FIG. 5, when the playpen is to be folded, a user may pull the strap 80 upward to move the latch member 70 out of the recess 61 of the outer joint member 60, and then turn the inner and outer joint members 60 and 50 with respect to each other in a predetermined direction. This folds the playpen into a configuration as shown in FIGS. 6 and 7. The playpen is extended by turning the inner and outer joint member 60 and 50 in a direction opposite to the direction of folding. At this time, the latch tongue 72 of the latch member 70 permits the latch member 70 to automatically extend into the recess 61 of the inner joint member 60 and lock the two joint member 50 and 60 together.

Figure 8:
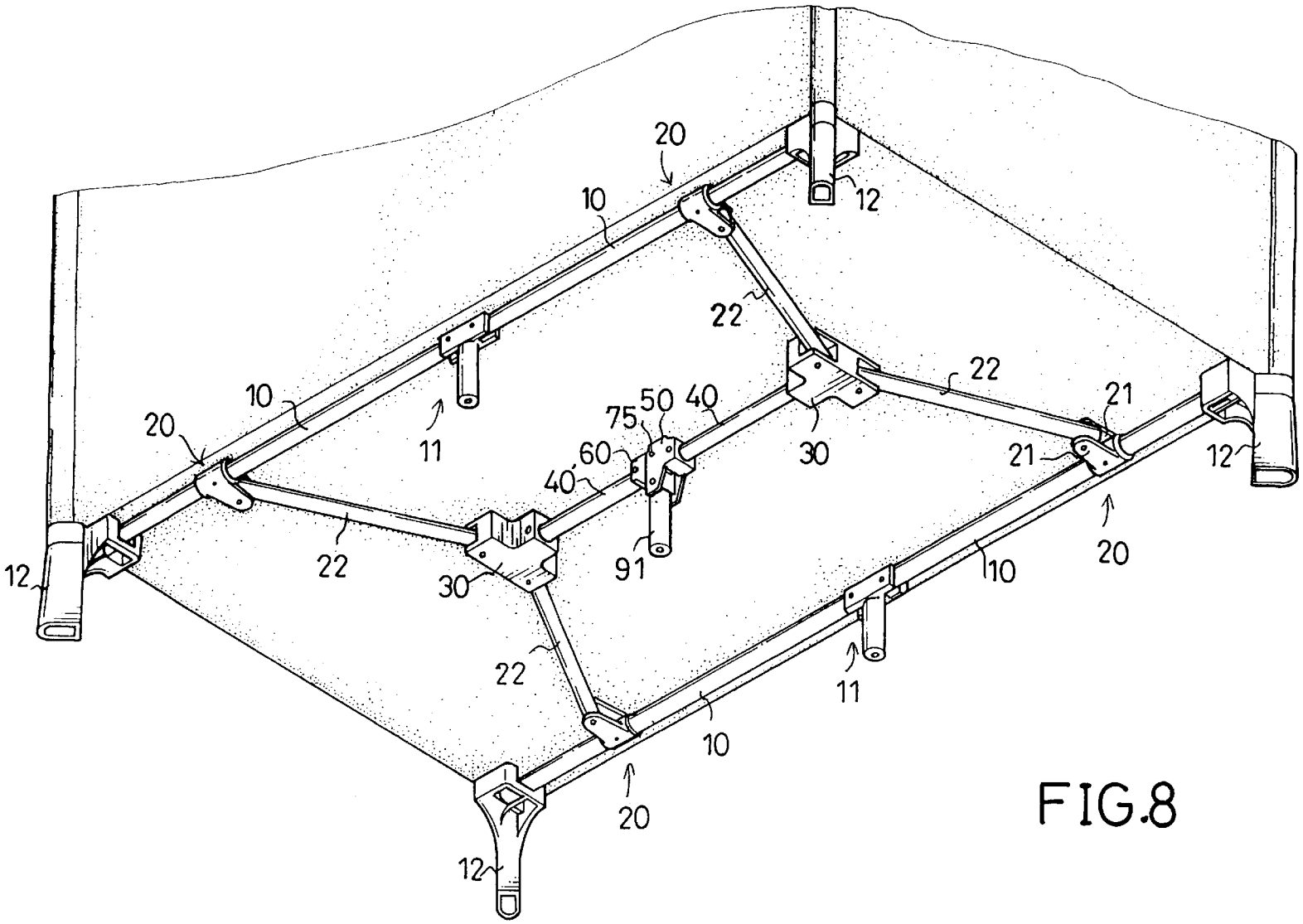
FIG. 8 is a perspective bottom view of another preferred embodiment of a foldable base in accordance with the present invention for a playpen.

Referring to FIG. 8, in another embodiment of a foldable base in accordance with the present invention, the inner joint member 50 further includes a foot member 91 extending therefrom, providing an additional support for the foldable base on the ground.

The foldable base according to the present invention has the advantage that the side rails 10, the bars 22, the T-shaped joints 30, the connecting rods 40, and the outer and inner joint members 50 and 60 are reasonably arranged to form a structure having a high strength, so that a wooden board put on the foldable base can provide a superior support for an infant whether the baby stands or is laid thereon. In other words, the foldable base of a playpen of the invention has such an arrangement that is can surely prevent a baby standing or lying on the base from accidently collapsing the playpen.

What is claimed is:

1. An improved foldable base for a playpen comprising:

a first pair of side rails having a first side joint centrally and pivotally connected therebetween;

a second pair of side rails having a second side joint centrally and pivotally connected therebetween;

a pair of T-shaped joints situated between said pairs of rails;

a center joint having an outer joint member, an inner joint member pivotally connected with said outer joint member, locking means for preventing and allowing rotation of said outer joint member and said inner joint member in relation to each other, a latch member provided with a latch tongue for facilitating said latch member to extend into said inner joint member and a foot member extending from the inner joint member and is arranged to provide support for the playpen against a surface;

two pairs of bars, each pair of said bars having one of said T-shaped joints pivotally connected therebetween and being pivotally connected with said pairs of side rails via ears provided with a pair of wings extending therefrom for receiving an end of said bar therebetween;

two linking rods each fixedly connected at an end thereof with one of said T-shaped joints and fixedly secured at an opposing end thereof to said inner joint member and said outer joint member, respectively, of said center joint;

wherein a pivotal movement between said inner joint member and said outer joint member facilitates folding of said base.

* * * * *